US005156285A

United States Patent [19]

Zogg et al.

[11] Patent Number: 5,156,285

[45] Date of Patent: Oct. 20, 1992

[54] EASY GRIP BOTTLE

[75] Inventors: Jon Zogg, Yonkers, N.Y.; Enrique F. Stinga, Passaic, N.J.

[73] Assignee: Colgate-Palmolive Company, New York, N.Y.

[21] Appl. No.: 533,327

[22] Filed: Jun. 5, 1990

[51] Int. Cl.[5] ..... B65D 1/02; B65D 23/10

[52] U.S. Cl. ..... 215/100 A; 220/755; 220/771

[58] Field of Search ..... 215/1 R, 1 C, 100 A; 220/94 A; D9/409

[56] References Cited

U.S. PATENT DOCUMENTS

| | | | |
|---|---|---|---|
| D. 171,647 | 3/1954 | Hills | 215/1 R X |
| D. 217,439 | 5/1970 | Platte | 220/94 A X |
| D. 277,551 | 2/1985 | Kerr | 215/100 A X |
| D. 310,329 | 9/1990 | Schmidt | D9/409 |
| 1,602,391 | 10/1926 | Creaver | 215/1 R |
| 1,636,174 | 7/1927 | Docan et al. | 215/1 R |
| 1,872,771 | 8/1932 | Little | 220/94 A |
| 2,013,243 | 9/1935 | Landon | 215/1 R |
| 2,018,878 | 10/1935 | Stein | 215/1 R |
| 2,022,520 | 11/1935 | Philbrick | 215/1 R |
| 3,537,498 | 11/1970 | Amand | 220/94 A X |
| 4,804,097 | 2/1989 | Alberghini et al. | 215/100 A |

FOREIGN PATENT DOCUMENTS

| | | | |
|---|---|---|---|
| 2532621 | 3/1984 | France | 215/100 A |
| 0285142 | 3/1990 | Japan | 215/100 A |
| 940326 | 10/1963 | United Kingdom | 215/6 |

*Primary Examiner*—Sue A. Weaver

*Attorney, Agent, or Firm*—Michael J. McGreal; Robert C. Sullivan

[57] ABSTRACT

The bottle has two essentially identical indentations on essentially opposite sides for gripping and manipulating the bottle. The indentation are designed to provide for the same gripping feel whether gripped front or the back. The indentations are also designed to accept a thumb and one to four fingers. The positive gripping with the same grip feel allows the bottle to be used in either hand. This decreases the number of times that a bottle must be handled during use. It also decreases the likelihood that the bottle will be dropped while being handled.

9 Claims, 2 Drawing Sheets

EASY GRIP BOTTLE

FIELD OF THE INVENTION

This invention relates to a bottle which can be easily gripped from the front or rear. More particularly, this invention relates to a bottle that when gripped from the front or rear provides for the same gripping feel thereby decreasing probability that the bottle would be dropped.

BACKGROUND OF THE INVENTION

As larger size bottles are used in packaging various household products, there is a need to provide for an effective way to grip the bottles. This is the case since from the time of purchase by the consumer until the liquid that is in the bottle has been consumed the bottle will be handled many times. During this handling, it is important that the bottle not be dropped. Whenever a bottle is dropped, there is the possibility of spillage of some of the contained substance as well as the possibility of causing the bottle to fracture. It is, thus, a continuing concern on the part of manufacturers of household products to provide bottle containers which can be easily gripped and which can be maneuvered with a minimal probability of being dropped.

Smaller sized bottles generally do not require a separate gripping means. This is the case since the bottle will be fairly tightly gripped within a person's hand. However, as the size of the bottle exceeds about a 500 ml volume size the technique that is to be provided for the gripping of the bottle becomes important. Further, as the size of the bottle increases to one to two liters in size the technique that is to be provided for gripping the bottle becomes a very distinct concern. One technique that has been utilized with regard to the larger sized bottles is to provide the bottle with a handle. Such handles are usually integrally molded with the body of the container. Bottles with handles are used for packaging milk in a volume of about four liters as well as various fabric detergents in the two liter to four liter size. For these bottles, it is convenient to utilize handles which can be easily and readily gripped by a person's hand. However, for bottles in a size range of about one half liter to about two liters there is generally no convenient and positive gripping technique. These bottles are generally of too small a volume to efficiently incorporate a separate handle, but yet must be able to be positively gripped and maneuvered while being gripped. The present invention is directed to the problem of providing a positive gripping technique for bottles which are within this size range. It also provides a means for gripping a bottle manufactured from materials which do not allow the integral molding of handles.

This problem is now solved in a very unique manner. In the present invention, there is provided a gripping means for a bottle whereby whether the bottle is gripped from the front or from the rear, the gripping action and the gripping hand feel is essentially the same. In this way in order to get a comfortable gripping feel, a person does not have to turn a bottle to a different orientation or pass the bottle from one hand to the other in order to dispense a product. Further, there is a decreased likelihood of the bottle being dropped since the gripping feel is the same whether the bottle is gripped from the front or from the rear. This provides an added degree of confidence when the bottle is picked up and product dispensed from the bottle.

BRIEF SUMMARY OF THE INVENTION

The present invention is directed to a bottle which can be easily gripped in a positive manner and thereafter maneuvered with a high degree of confidence that the grip on the bottle will be maintained. Further, the gripping means for this bottle is such that the bottle can be gripped from the front or from the back with the result that the bottle has the same gripping feel. That is, it is symmetrical on the front and back. This serves to increase the degree of confidence of the person gripping the bottle that it will not be accidentally dropped.

The gripping technique that is utilized with this bottle is comprised of at least two indentations in the body portion of the bottle. Each indentation is similar in shape. In structure, each indentation has two edges. One edge of the indentation will have essentially the same contour as the side of the bottle. The second edge of each indentation will have a contour which is displaced into the contour of the bottle. In this way, there are two gripping edges. One is an edge which follows along the contour of the bottle while the other edge is a recessed edge. In gripping the bottle a persons thumb can be placed over a recessed edge into one of the indentations and one or more fingers of the hand will be placed over the edge which is along the contour of the bottle. This provides for a firm grip on the bottle. Further, it is an embodiment of the present invention that the bottle have an upper shoulder portion which is located above the indentations. This enhances the gripping of the bottle. It is an additional embodiment that the bottle be oval or rectangular in shape.

DETAILED DESCRIPTION OF THE INVENTION

As has been pointed out the present invention is directed to a unique gripping means for a bottle. Bottles the size of less than about 500 milliters can be easily gripped in a persons hand and fairly easily manipulated to dispense the contained product. It is also the case that for bottles of a volume of two liters or more that an integral handle which can be gripped by the full hand is a convenient method for carrying the bottle and for maneuvering the bottle when it is desired to dispense the contained product. However, in the size range of about 500 milliters to about two liters there is no convenient and positive technique for gripping these bottles and for maneuvering the bottle in order to dispense the contained liquid. The present bottle resolves this problem and provides for a convenient and positive technique for gripping a bottle and for thereafter maneuvering the bottle to dispense the contained product. The present bottle also provides a method for the positive gripping of bottles which cannot be formed with a handle. Polyethylene terephthalate bottles fall within this class.

The present gripping technique is an advantage since the gripping force is caused by the full hand. The thumb is on one side of the bottle and other fingers on the other side. This allows for the use of the strength of the full hand. This is in distinction to the use of a pinching action. A pinching action is primarily the result of work primarily by the fingers. Further, it is characteristically the work of only two fingers. This does not provide for an optimum grip. This is the case even when more than two fingers are used for the squeezing action.

Figure 1:
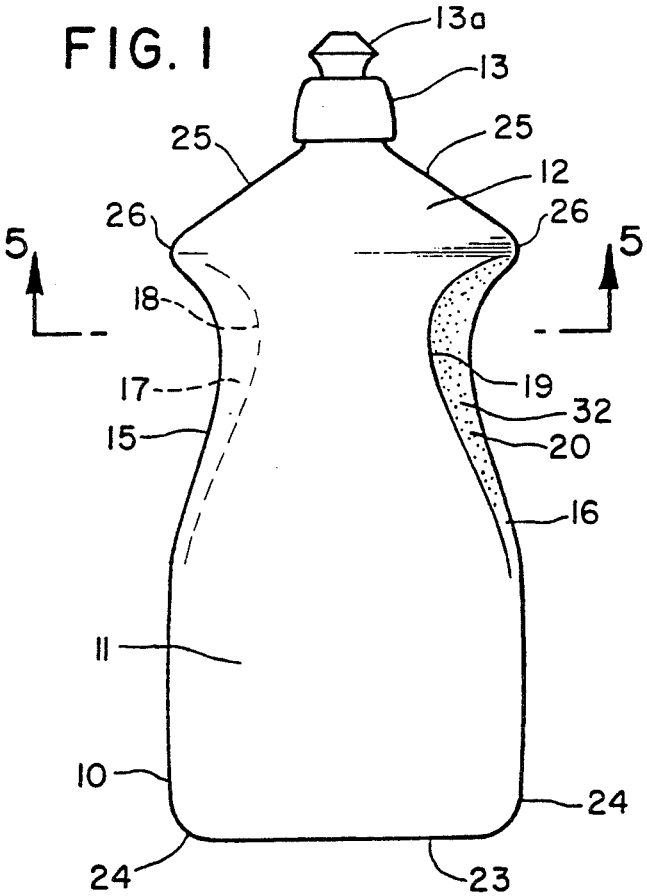
FIG. 1 is a front elevational view of the present bottle showing the gripping indentations.

In FIG. 1 there is shown the front or back of an embodiment of the present bottle. This bottle is shown to be of an oval shape. However, the bottle can be of a circular to a rectangular shape. In FIG. 1, bottle 10, is shown having a front wall surface 14 on a lower body portion 11 and an upper portion 12 which is located above shoulder 26. On the top of the bottle there is shown a cap 13 which has a dispensing closure 13(*a*). This cap 13 can be of any design and need not have the dispensing closure. This cap can be maintained on the bottle by means of threads or by being a pressed fit into the neck of the bottle. The front 14 of the body portion of the bottle is defined by side edges 15 and 16 and lower edge 23. Connecting the lower edge and the side edges are corners 24. The gripping indentations in the bottle are designated as 17 and 20, these indentations have a maximum depth in the region of the upper portion. The gripping indentation 17 is formed into the left side of the front surface 14. The gripping indentation 20 is formed into the right side of the back wall. Indentation 17 is formed by the edge 15 which is the edge of the contour of the side wall of the bottle in the region of the indentation. Recessed edge 18 forms the other edge of the indentation 17. On the other side of the front of the bottle, edge 16 defines the contour of the right side of the bottle. Shown in a dotted line view is the recessed edge 19 on the back surface of the bottle. In gripping this bottle with the right hand a person would place their thumb into indentation 17 on the front wall with one or more fingers of the same hand being placed within indentation 20 on the front wall. Usually the remaining four fingers would be put into indentation 20. This provides for a firm grip and a grip which is complimentary to the motion of a persons wrist in dispensing the material contained within the bottle.

Figure 2:
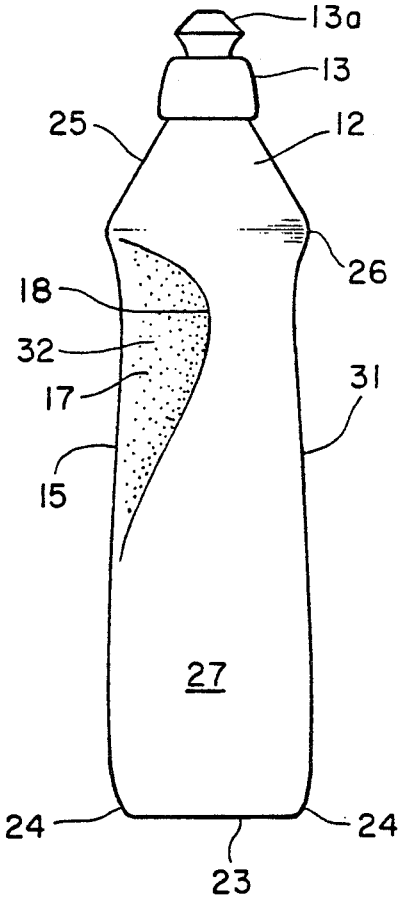
FIG. 2 is a side elevational view of the bottle of FIG. 1.

FIG. 2 is a view of the bottle from the left side. However, since the right side and the left side are identical, this can also be considered to illustrate the view of the right side of the bottle. The side surface is designated 27. The back surface of the bottle is designated 31. In this view, the indentation 17 is shown to be defined by bottle contour edge 15 and recessed edge 18. The shoulder of the bottle is shown at 26 and the upper portion 12 of the bottle being defined by surface 25. This view shows texturing 32 in grip indentation 17.

Figure 3:
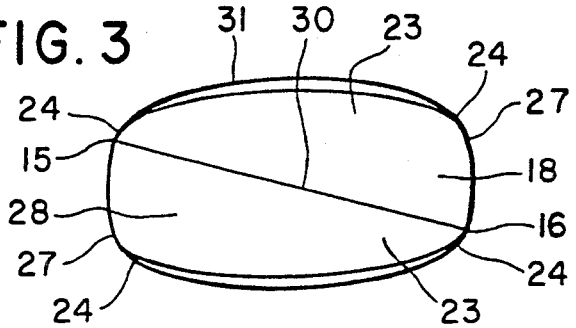
FIG. 3 is a bottom view of the bottle of FIG. 1.

FIG. 3 is a bottom view of the present bottle. The bottom surface is shown designated as 28. The line 30 designates the axis between the edge 15 and the edge 16 of the bottle. It is seen that these edges are at opposing corners of the bottle. In one preferred embodiment of the present invention, the bottle is symmetrical on each side of a plane through the bottle along the axis at 30.

Figure 4:
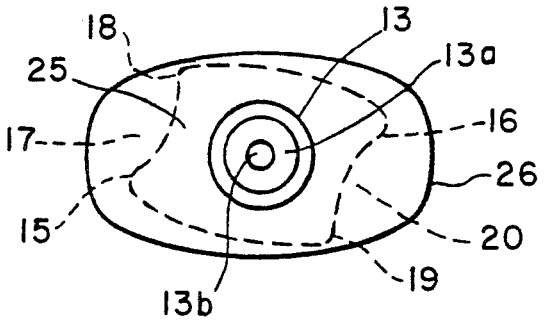
FIG. 4 is a top view of the bottle of FIG. 1.

FIG. 4 is a top view of the present bottle. Here, there is shown the cap 13 with the dispensing means 13(*a*). Shown in this view, is the dispensing aperture 13(*b*) of the dispensing means. Below the cap is upper surface 25 and shoulder 26. Shown in a dotted line view is the front surface 14 and rear surface 30 of the bottle. Also shown is indentation 20 formed by edges 16 and 19 and indentation 17 formed by edges 15 and 18.

Figure 5:
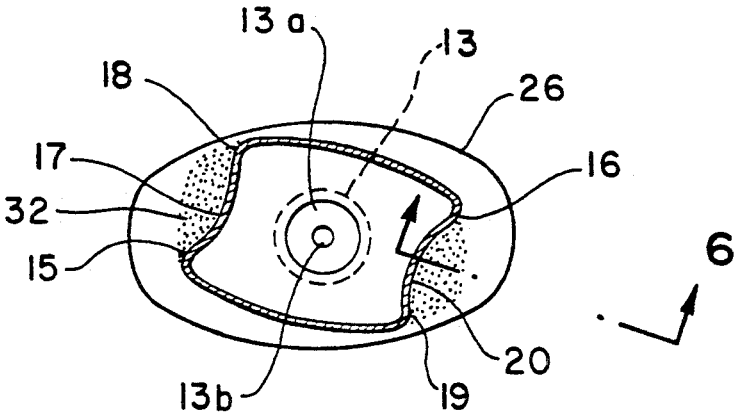
FIG. 5 is a view of the bottle of FIG. 1 along line 5—5 looking upwardly to the top part of the bottle.

FIG. 5 is a sectional view of the bottle of FIG. 1 looking upwardly into the dispensing end of the bottle. Here, there is seen indentation 20 formed by edges 16 and 19 and indentation 17 formed by edges 15 and 18. There is also shown shoulder 26. Shown in a dotted line depiction is the cap 13 and the dispensing means 13(*a*).

Figure 6:
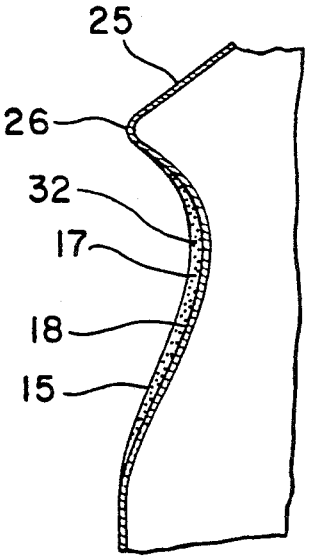
FIG. 6 is a sectional view of the bottle of FIG. 1 along line 6—6 of FIG. 5.

FIG. 6 is a sectional view of the right side of the present bottle. In this view, there is shown edges 15 and 18 which define the gripping indentation 17. Also shown is the shoulder 26 and the upper surface 25. The indentations 17 and 20 can be the same surface smoothness as the bottle or may be textured in order to enhance gripping and holding. The textured surface of the indentations can be formed while making the bottle. Essentially any texture design can be used.

An advantage of this type of a grip over a handle is that during filling the bottle does not need handle orienting. When filling a bottle with a handle, the handle of each bottle must be oriented in a specific direction. This results in the need for an additional step in the filling sequence. This is not required for the present bottle.

These bottles can be constructed of essentially any material. That is, they can be glass bottles or plastic bottles. These bottles can be transparent or opaque. If the bottles are plastic bottles, they can be constructed of polyethylene terephthalate or of polyenes. Suitable polyenes are polyethylene, polypropylene, polyisobutylene, vinyl acetate, and polyene copolymers such as polyethylene-vinyl acetate.

When the bottles are glass bottles, they can be produced utilizing currently available glass making equipment and techniques. When the bottles are of a plastic, it is preferred that the bottle be made by blow molding. However, known techniques other than blow molding can also be utilized.

These bottles are very conveniently used for personal care products such as shampoos, bath oils and lotions, detergents such as dishwashing detergents, fabric softeners, window washing liquids, disinfectants and other household products. The bottle has a very wide utility. As shown in the present drawings, the bottle has a dispenser cap assembly. However, the top of the bottle can be adapted to provide for essentially any convenient means for dispensing the contained product. This can range from a simple cap to complex closing dispensing arrangements. Further, there can be utilized on the top of the bottle a membrane closure which essentially is a membrane across the opening of the bottle with one or more slits in this opening. The slits function to aid in cutting off the substance which is being dispensed and to essentially isolate the substance remaining in the bottle from the atmosphere. This will prevent a drying out of the substance remaining in the bottle.

We claim:

1. A container comprising a lower body portion an upper portion including a shoulder and disposed above said shoulder a dispensing opening, the body portion having gripping means disposed adjacent said shoulder of said upper portion and comprising first and second elongated indentations, each indentation having a maximum depth in the region of said shoulder and having at least two elongated edges with each indentation being a mirror image of the other, one elongated edge of each indentation having essentially the contour of said body portion and the other elongated edge of each indentation having a contour that is displaced into the contour of said body portion with respect to the contour of said one elongated edge, said elongated indentations being symmetrical about a plane through the center axis of said container but offset from a minor axis and major axis of said container, whereby said container can be firmly gripped with the same grip feel from a first direction or a second direction using the same hand.

2. A container as in claim 1 wherein said container is of an oval shape having a front surface and a rear surface which are connected by side surfaces, said first and second elongated indentations being in each side surface with one elongated edge of each indentation being the contour of the side surface of said body portion and the edge of the other elongated indentation being displaced into the contour of the side surface of said body portion.

3. A container as in claim 1 wherein said indentations are of a size to accept up to four fingers for gripping.

4. A container as in claim 1 wherein one indentation accepts a thumb and the other indentation four fingers.

5. A container as in claim 1 wherein the surface of each indentation is textured to enhance gripping.

6. A container as in claim 1 wherein said container is oval in shape.

7. A container as in claim 1 wherein said container has a volume of about 500 ml to 2000 ml.

8. A container as in claim 1 wherein said container has a cap closure.

9. A container as in claim 1 wherein said cap closure is a dispensing cap closure.

* * * * *